US007173407B2

(12) United States Patent
Marinca

(10) Patent No.: US 7,173,407 B2
(45) Date of Patent: Feb. 6, 2007

(54) PROPORTIONAL TO ABSOLUTE TEMPERATURE VOLTAGE CIRCUIT

(75) Inventor: Stefan Marinca, Limerick (IE)

(73) Assignee: Analog Devices, Inc., Norwood, MA (US)

( * ) Notice: Subject to any disclaimer, the term of this patent is extended or adjusted under 35 U.S.C. 154(b) by 295 days.

(21) Appl. No.: 10/881,300

(22) Filed: Jun. 30, 2004

(65) Prior Publication Data

US 2006/0001413 A1 Jan. 5, 2006

(51) Int. Cl.
*G05F 3/16* (2006.01)

(52) U.S. Cl. ..... 323/316

(58) Field of Classification Search ..... 323/312, 323/313, 314, 315, 316, 907; 327/538, 539
See application file for complete search history.

(56) References Cited

U.S. PATENT DOCUMENTS 4,399,398 A 8/1983 Wittlinger
5,352,973 A * 10/1994 Audy ..... 323/313
5,796,244 A * 8/1998 Chen et al. ..... 323/313
6,531,857 B2 * 3/2003 Ju ..... 323/316
6,664,847 B1 12/2003 Ye
6,690,228 B1 2/2004 Chen et al.
6,815,941 B2 * 11/2004 Butler ..... 323/313
6,885,178 B2 * 4/2005 Marinca ..... 323/316
6,906,581 B2 * 6/2005 Kang et al. ..... 327/539
6,930,538 B2 * 8/2005 Chatal ..... 327/539
2003/0234638 A1 12/2003 Eshraghi et al.

OTHER PUBLICATIONS

PCT/EP2005/052737 International Search Report, Sep. 23, 2005.
Gray, Paul R., et al, *Analysis And Design Of Analog Integrated Circuits,* Chapter 4, 4th ed., John Wiley & Sons, Inc., 2001, pp. 253-327.

* cited by examiner

*Primary Examiner*—Adolf Berhane
(74) *Attorney, Agent, or Firm*—Wolf, Greenfield & Sacks, P.C.

(57) ABSTRACT

A voltage circuit including a first amplifier having first and second inputs and having an output driving a current mirror circuit is provided. Outputs from the current mirror circuit drive first and second transistors which are coupled to the first and second input of the amplifier respectively. The base of the first transistor is coupled to the second input of the amplifier and the collector of the first transistor is coupled to the first input of the amplifier such that the amplifier keeps the base and collector of the first transistor at the same potential. The first and second transistors are adapted to operate at different current densities such that a difference in base emitter voltages between the first and second transistors may be generated across a resistive load coupled to the second transistor, the difference in base emitter voltages being a PTAT voltage.

38 Claims, 7 Drawing Sheets

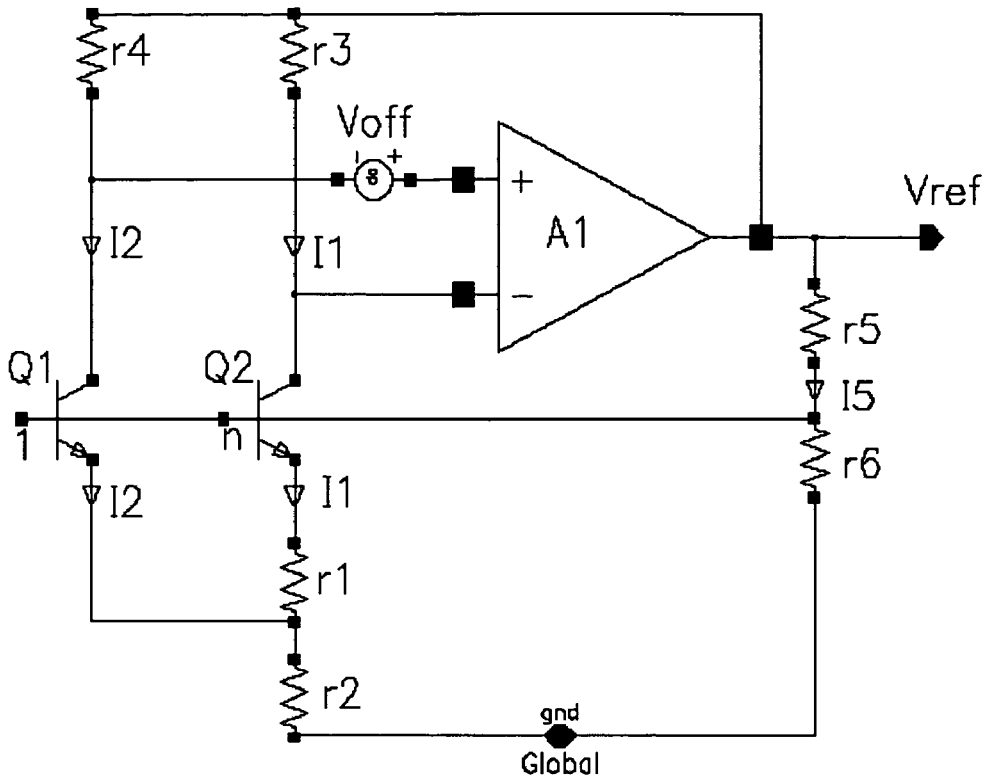
Figure 1: Prior Art
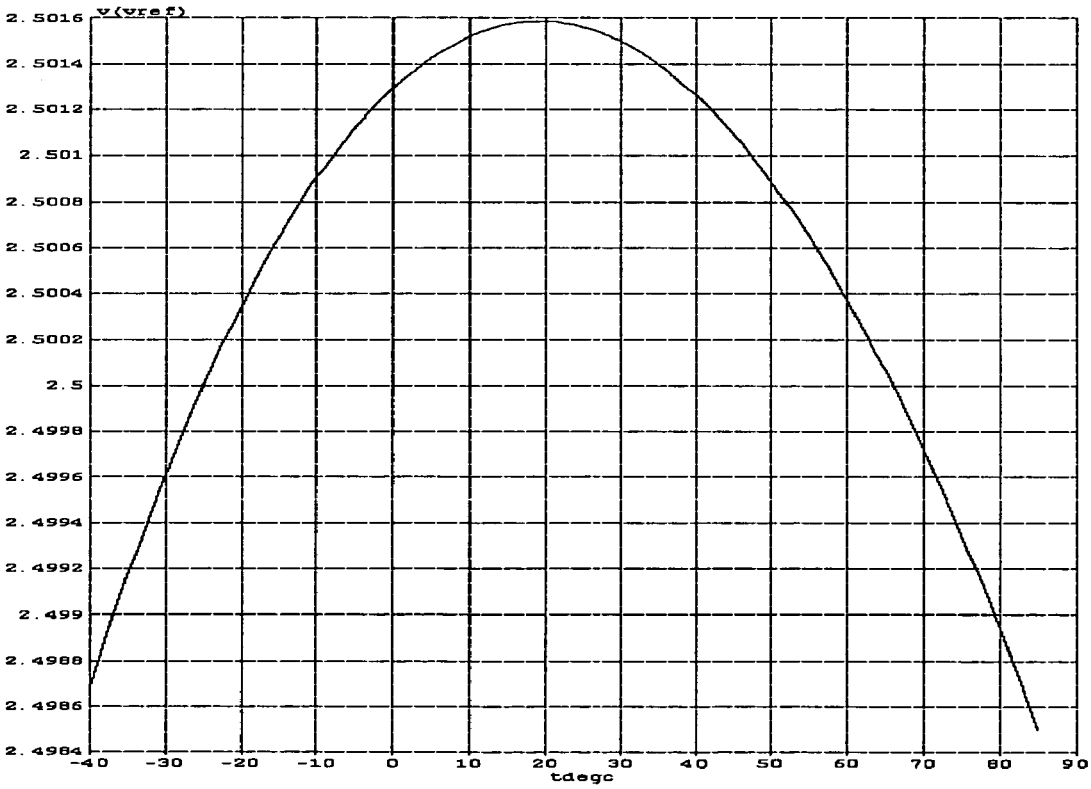
Figure 2: Prior Art

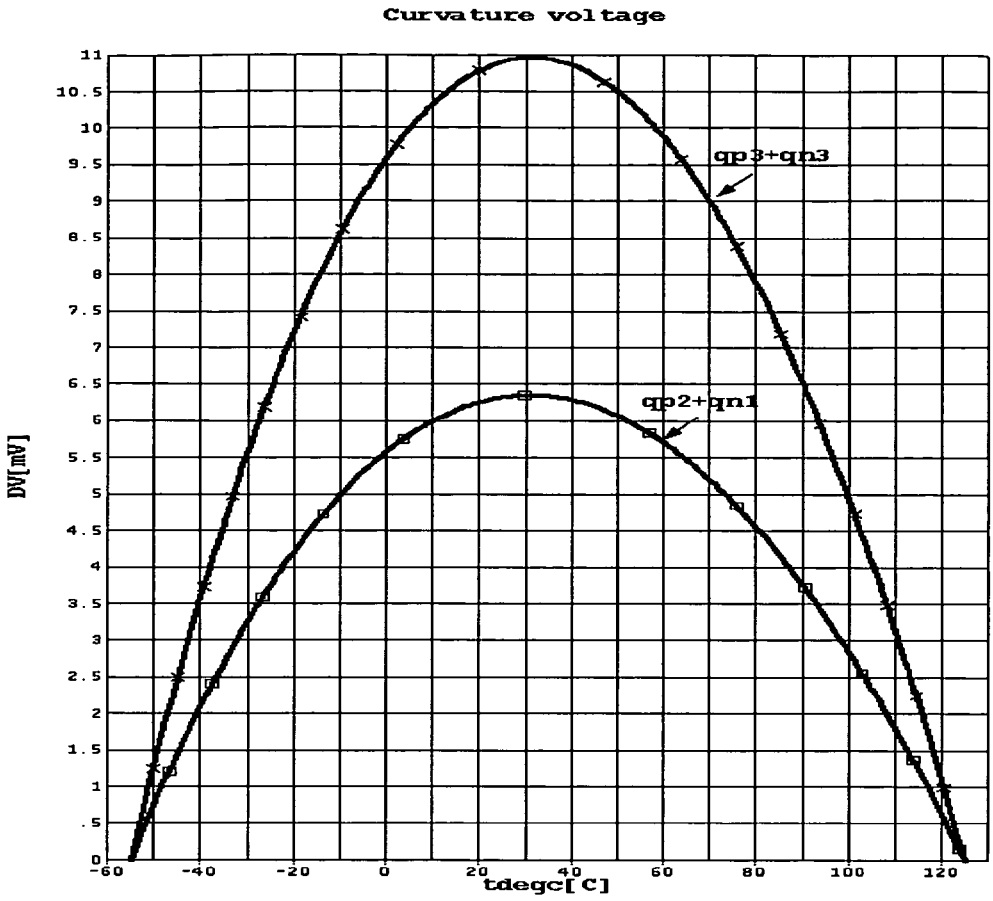
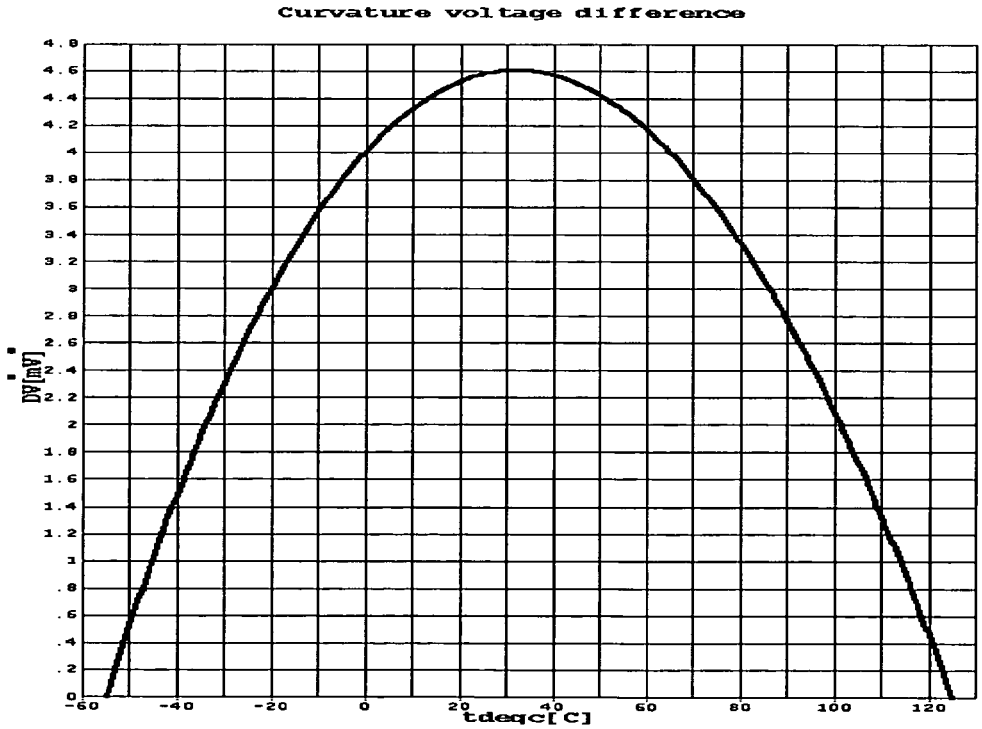
Figure 9

PROPORTIONAL TO ABSOLUTE TEMPERATURE VOLTAGE CIRCUIT

The present invention relates to voltage circuits and in particular to circuits adapted to provide a Proportional to Absolute Temperature (PTAT) output. In accordance with a preferred embodiment the invention provides a voltage reference circuit implemented using bandgap techniques and incorporating a PTAT voltage circuit. The voltage circuit of the present invention can easily be provided as a current circuit equivalent.

BACKGROUND OF THE INVENTION

Voltage generating circuits are well known in the art and are used to provide a voltage output with defined characteristics. Known examples include circuits is adapted to provide a voltage reference, circuits having an output that is proportional to absolute temperature (PTAT) so as to increase with increasing temperature and circuits having an output that is complimentary to absolute temperature (CTAT) so as to decrease with increasing temperature. Those circuits that have an output that varies predictably with temperature are typically used as temperature sensors whereas those whose output is independent of temperature fluctuations are used as voltage reference circuits. It will be well known to those skilled in the art that a voltage generating circuit can be easily converted to a current generating circuit and therefore within the present specification for the ease of explanation the circuits will be described as voltage generating circuits.

One specific category of voltage reference circuit is that known as a bandgap circuit. A bandgap voltage reference circuit is based on addition of two voltages having equal and opposite temperature coefficient. The first voltage is a base-emitter voltage of a forward biased bipolar transistor. This voltage has a negative TC of about −2.2 mV/C and is usually denoted as a Complementary to Absolute Temperature or CTAT voltage. The second voltage which is Proportional to Absolute Temperature, or a PTAT voltage, is formed by amplifying the voltage difference ($\Delta V_{be}$) of two forward biased base-emitter junctions of bipolar transistors operating at different current densities. These type of circuits are well known and further details of their operation is given in Chapter 4 of "Analysis and Design of Analog Integrated Circuits", $4^{th}$ Edition by Gray et al, the contents of which are incorporated herein by reference.

A classical configuration of such a voltage reference circuit is known as a "Brokaw Cell", an example of which is shown in FIG. 1. First and second transistors Q1, Q2 have their respective collectors coupled to the non-inverting and inverting inputs of an amplifier A1. The bases of each transistor are commonly coupled, and this common node is coupled via a resistor, r5, to the output of the amplifier. This common node of the coupled bases and resistor r5 is coupled via another resistor, r6, to ground. The emitter of Q2 is coupled via a resistor, r1, to a common node with the emitter of transistor Q1. This common node is then coupled via a second resistor, r2, to ground. A feedback loop from the output node of A1 is provided via a resistor, r3, to the collector of Q2, and via a resistor r4 to the collector of Q1.

In FIG. 1, the transistor Q2 is provided with a larger emitter area relative to that of transistor Q1 and as such, the two bipolar transistors Q1 and Q2 operate at different current densities. Across resistor r1 a voltage, $\Delta V_{be}$, is developed of the form:

$$\Delta V_{be} = \frac{KT}{q}\ln(n) \tag{1}$$

where

K is the Boltzmann constant, q is the charge on the electron,

T is the operating temperature in Kelvin, n is the collector current density ratio of the two bipolar transistors.

Usually the two resistors r3 and r4 are chosen to be of equal value and the collector current density ratio is given by the ratio of emitter area of Q2 to Q1. In order to reduce the reference voltage variation due to the process variation Q2 may be provided as an array of n transistors, each transistor being of the same area as Q1.

The voltage $\Delta V_{be}$ generates a current, I1, which is also a PTAT current. The voltage of the common base node of Q1 and Q2 will be:

$$V_b = 2\Delta V_{be} * \frac{r_2}{r_1} + V_{be1} \tag{2}$$

By properly scaling the resistor's ratio and the collector current density the voltage "Vb" is temperature insensitive to the first order, and apart from the curvature which is effected by the base-emitter voltage ($V_{be}$) can be considered as remaining compensated. The voltage "Vb" is scaled to the amplifier's output as a reference voltage, $V_{ref}$, by the ratio of r5 to re:

$$V_{ref} = \left(2\Delta V_{be} * \frac{r_2}{r_1} + V_{be1}\right)\left(1 + \frac{r_5}{r_6}\right) + (I_b(Q_1) + I_b(Q_2))r_5 \tag{3}$$

Here $I_b(Q_1)$ and $I_b(Q_2)$ are the base currents of Q1 and Q2.

Although a "Brokaw Cell" is widely used, it still has some drawbacks. The second term in equation 3 represents the error due to the base currents. In order to reduce this error r5 has to be as low as possible. As r5 is reduced, the current extracted from supply voltage via reference voltage increases and this is a drawback. Another drawback is related to the fact that as the operating temperature of the cell changes, the collector-base voltage of the two transistors also changes. As a result of the Early effect (the effect on transistor operation of varying the effective base width due to the application of bias), the currents into the two transistors are affected. Further information on the Early effect may be found on page 15 of the aforementioned $4^{th}$ Edition of the Analysis and Design of Analog Integrated Circuits, the content of which is incorporated herein by reference.

A very important feature of the Brokaw cell is its reduced sensitivity to the amplifier's offset and noise as the amplifier controls the collector currents of the two bipolar transistors.

An offset voltage, Voff, at the input of the amplifier A1 in FIG. 1 has a corresponding effect of imbalancing the currents I1 and I2 according to:

$$I_2 r_4 - V_{Off} = I_1 r_3 \tag{4}$$

The base-emitter voltage difference between Q1 and Q2, $\Delta V_{be}$, reflected across r1 is:

$$\Delta V_{be} = \frac{KT}{q}\ln\left(n\frac{I_2}{I_1}\right) \quad (5)$$

For $r_3=r_4$ we can get:

$$\Delta V_{be} = \frac{KT}{q}\ln(n) + \frac{KT}{q}\ln\left(1 + \frac{V_{off}}{\Delta V_{be}}\frac{r_1}{r_4}\right) \quad (6)$$

The second term of (6) represents the error into the base-emitter voltage difference due to the offset voltage. This term can be reduced by making $r_4$ larger compared to $r_1$. However, by making $r_4$ larger, the Early effect is exaggerated which is not desirable. A reasonable trade-off could be choosing the values of r4 and r1 such that $r_4=4r_1$. Using typical values for voltage reference circuits and assuming that $r_4=4r_1$, Voff=1 mV and $\Delta V_{be}$=100 mV (at 25° C.) and the error due to the offset voltage in equation (6) is of the order of 0.065 mV. This error is reflected into the reference voltage according to equation (3). Assuming $r_2=3r_1$ and $r_5=r_6$ the offset voltage of 1 mV is reflected as 0.77 mV into the reference voltage. As the amplifier controls the collector currents each millivolt offset voltage is reflected as 0.77 mV error into the reference voltage. In the same way the amplifier's noise is reflected into the reference voltage, both of which are undesirable effects.

The "Brokaw Cell" also suffers, in the same way as all uncompensated reference voltages do, in that it is affected by "curvature" of base-emitter voltage. The base-emitter voltage of a bipolar transistor, used as a complimentary to absolute temperature (CTAT) voltage in bandgap voltage references, and as biased by a proportional to absolute temperature (PTAT) collector current is temperature related as equation 7 shows:

$$V_{be}(T) = V_{G0}\left(1 - \frac{T}{T_0}\right) + V_{be0}\frac{T}{T_0} - (\sigma - 1)\frac{kT}{q}\ln\left(\frac{T}{T_0}\right) \quad (7)$$

where:

$V_{be}(T)$ is the temperature dependence of the base-emitter voltage for the bipolar transistor at operating temperature, $V_{BE0}$ is the base-emitter voltage for the bipolar transistor at a reference temperature, $V_{G0}$ is the bandgap voltage or base-emitter voltage at 0K temperature, $T_0$ is the reference temperature, σ is the saturation current temperature exponent (sometimes referred as XTI in computer added simulators).

The PTAT voltage developed across r2 in FIG. 1 only compensates for the first two terms in equation 7. The last term, which provides a "curvature" of the order of about 2.5 mV for the industrial temperature range (−40 C to 85 C) remains uncompensated and this is also gained into the reference voltage according to equation 3. An example of such curvature, which is a T log T effect, is given in FIG. 2.

As the "Brokaw Cell" is well balanced, it is not easy to compensate internally for the "curvature" error. One attempt to compensate this error is presented in U.S. Pat. No. 5,352,973 co-assigned to the assignee of the present invention, the disclosure of which is incorporated herein by way of reference. In this US patent, although the "curvature" error is compensated, in this methodology by use of a separate circuit which biases an extra bipolar transistor with constant current, it does require the use of an additional circuit.

Other known examples of bandgap reference circuits include those described in U.S. Pat. No. 4,399,398 assigned to the RCA Corporation which describes a voltage reference circuit with feedback which is adapted to control the current flowing between first and second output terminals in response to the reference potential departing from a predetermined value. The circuits serves to reduce the base current effect, but at the cost of high power. As a result, this circuit is only suited for relatively high current applications.

It will be appreciated therefore that although the circuitry described in FIG. 1 has very low offset and noise sensitivity, there is still a need to provide for further reduction in sensitivity to offset and noise.

SUMMARY OF THE INVENTION

These and other problems of the present invention are addressed by a first embodiment of the invention which provides an improved voltage circuit.

In accordance with the present invention, a voltage circuit including a first amplifier having first and second inputs and having an output driving a current mirror circuit is provided. Outputs from the current mirror circuit are adapted to drive first and second transistors which are coupled to the first and second input of the amplifier respectively, the base of the first transistor being coupled to the second input of the amplifier and the collector of the first transistor being coupled to the first input of the amplifier such that the amplifier keeps the base and collector of the first transistor at the same potential. The second transistor is provided in a diode configuration, and the first and second transistors are adapted to operate at different current densities such that a difference in base emitter voltages between the first and second transistors may be generated across a resistive load coupled to the second transistor, the difference in base emitter voltages being a PTAT voltage.

Desirably, the current mirror circuit includes a master and a slave transistor, the master transistor being coupled to the second transistor and the slave transistor being coupled to the first transistor. The slave and first transistor may form a first stage of an amplifier.

The master and slave transistors are typically provided as p-type transistors and the first and second transistors are provided as n-type transistors. In an alternative configuration, the master and slave are provided as n-type and the first and second as p-type. Usually, the transistors are provided as bipolar type transistors.

The resistive load may be provided in series between the base of the first transistor and the collector of the second transistor. However in other embodiments, the base of the first transistor is directly coupled to the collector of the second transistor, the resistive load being provided in series between the emitter of the second transistor and the emitter of the first transistor.

The emitters of the first and second transistors may be both coupled via a second resistive load to ground.

The base emitter voltages of the first transistor and the slave transistor are typically configured to provide a complimentary to absolute temperature (CTAT) voltage which is combined by the amplifier with the PTAT voltage to provide a voltage reference at the output of the amplifier.

In such an embodiment, the emitters of the first and second transistors are usually both coupled via a second resistive load to ground, the circuit including additional circuitry adapted to provide curvature correction, the additional circuitry including a CTAT current source and a third resistive load, the third resistive load being coupled to the emitters of the first and second transistors and whereby a scaling of the value of the second and third resistive loads may be used to correct for curvature.

The CTAT current may be mirrored by a second set of current mirror circuitry, the second set of current mirror circuitry including a master and a slave transistor and wherein the slave transistor is coupled to the output of the amplifier through two diode connected transistors, the third resistive load being coupled to the slave transistor, such that a CTAT current reflected on the collector of the slave transistor is pulled from the output of the amplifier so as to generate across the third resistive load a signal of the type of T log T, where T is the absolute Temperature.

Such a CTAT current source may be externally provided to the circuit, or alternatively internally generated. Such a latter embodiment may be provided by modifying the circuit to include a fourth resistive load, the fourth resistive load being provided between the output of the amplifier and the commonly coupled emitters of the first and second transistors, the provision of the fourth resistive load enabling a scaling of the voltage provided at the output of the amplifier.

In certain configurations, the emitter areas of the master and slave transistors are different, such that the master and slave transistors operate at different current densities thereby increasing the open loop gain of the circuit.

In accordance with another embodiment of the invention a voltage circuit including a first amplifier having first and second inputs is provided, the amplifier having a first and second transistors coupled to the first and second inputs respectively of the amplifier. In such an embodiment, the first transistor is additionally coupled to the second input of the amplifier such that the amplifier keeps the base and collector nodes of the first transistor at the same potential. The second transistor is operable at a higher current density to that of the first transistor such that a difference in base emitter voltages between the two transistors may be generated across a load. The circuit may be further configured to include a current mirror circuit provided in a feedback path between the amplifier output and the first and second transistor, the current mirror being adapted to supply a base current for the first and second transistors such that the base collector voltage of each of the transistors is minimized thereby reducing the Early effect.

Yet a further embodiment of the invention provides a bandgap voltage reference circuit comprising a bridge arrangement of transistors including a first and second arm providing first and second inputs to an amplifier which in turn provides a voltage reference as an output. Each arm of the bridge includes a transistor, the transistor of the second arm being operable at a higher current density to that of the transistor of the first arm such that a voltage reflective of the difference in base emitter voltages between the first and second transistors is generated across a resistor within a resistor network provided as part of the second arm. The first arm is coupled at an intermediate point within the network to the second arm and the bridge is coupled to the voltage reference from the amplifier output such that the amplifier reduces the base collector voltage of the transistor of the first arm.

In accordance with a further embodiment, the invention provides a bandgap voltage reference circuit including a first amplifier having first and second inputs and providing at its output a voltage reference, the circuit including:

a first arm coupled to the first input, the first arm having a first and second transistor of the circuit, the bases of each of the first and second transistor being coupled together, the first transistor being additionally coupled to the amplifier output, a second arm coupled to the second input, the second arm having a third and fourth transistor of the circuit and a load resistor, the fourth transistor having an emitter area larger than that of the second transistor, the third transistor being coupled to the amplifier output, and wherein:

the load resistor provides, in use, a measure of the difference in base emitter voltages of the second and fourth transistors, $\Delta V_{be}$, for use in the formation of the bandgap reference voltage, and wherein the commonly coupled bases of the first and second transistors are additionally coupled to the base of the third transistor and the second input of the amplifier thereby coupling the first and second arms and providing a base current for all three transistors, the amplifier, in use, keeping the base and collector of the first transistor at the same potential.

The invention also provides a method of providing a bandgap reference circuit, the method comprising the steps of providing a first amplifier having first and second inputs and generating, in use, at its output a voltage reference, providing a first arm coupled to the first input, the first arm having a first and second transistor of the circuit, the bases of each of the first and second transistor being coupled together, the first transistor being additionally coupled to the amplifier output, providing a second arm coupled to the second input, the second arm having a third and fourth transistor of the circuit and a load resistor, the fourth transistor having an emitter area larger than that of the second transistor, the third transistor being coupled to the amplifier output, such that, in use,:

the load resistor provides, in use, a measure of the difference in base emitter voltages of the second and fourth transistors, $\Delta V_{be}$, for use in the formation of the bandgap reference voltage, the commonly coupled bases of the first and second transistors are additionally coupled to the base of the third transistor and the second input of the amplifier thereby coupling the first and second arms and providing a base current for all three transistors, the amplifier, in use, keeping the base and collector of the first transistor at the same potential.

These and other features of the present invention will be better understood with reference to the following drawings.

BRIEF DESCRIPTION OF THE DRAWINGS

FIG. 1 is an example of a "Brokaw Cell" in accordance with a classical prior art implementation.

FIG. 2 is an example of curvature that is inherently present in bandgap reference circuits.

FIG. 9 is an example of a simulated performance characteristics of a circuit in accordance with the present invention showing the deviation from the straight line (or curvature) of the base-emitter voltage of qp3 plus qn3, and the corresponding voltage deviation of qp1 plus qn2.

DETAILED DESCRIPTION OF THE DRAWINGS

FIGS. 1 and 2 have been described with reference to the prior art.

Figure 3:
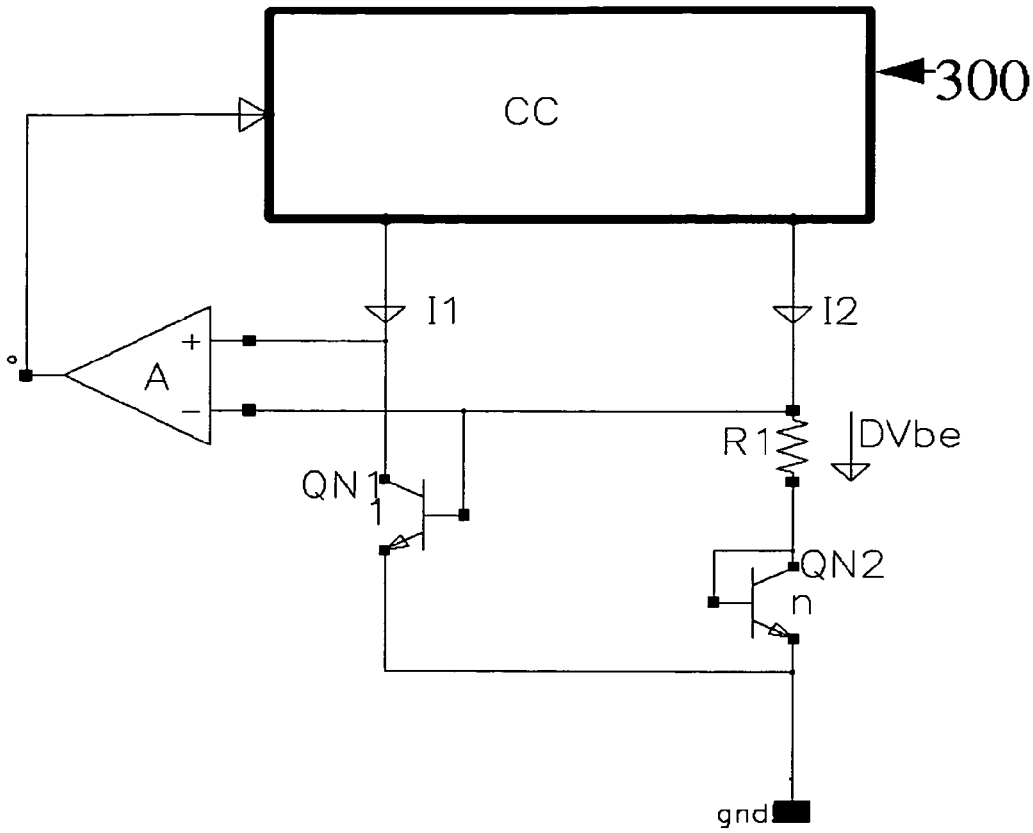
FIG. 3 is an example of a PTAT voltage generating circuit in accordance with a first embodiment of the present invention.

FIG. 3 provides a voltage circuit in accordance with the present invention. The circuit includes an amplifier A having an inverting and non-inverting input. A current mirror circuit, 300, is coupled at the output of the amplifier and is used to bias two bipolar transistors QN1 and QN2 which are coupled to the non-inverting and inverting inputs respectively. QN2 is provided having an emitter area of n times that of QN1 and a voltage representative of the difference in base emitter voltages between the two transistors is generated across a resistor R1 provided in series with QN2. QN2 is provided in a diode connected configuration with the base coupled directly to the collector and the base of QN1 is coupled to R1. As such the two arms of the amplifier, a first arm being coupled to the inverting input and a second arm to the non-inverting input, are also coupled.

As the base and collector of QN2 are coupled to each other there is no base collector voltage generated across QN2. The collector of QN1 is coupled to the non-inverting input of the amplifier and the base is coupled to the inverting input. In accordance with standard operation of the amplifier in keeping both inputs at the same potential, both the base and collector are kept at the same potential. Therefore there is no base collector voltage generated across QN1. The absence of a base collector voltage on both QN1 and QN2 reduces the Early effect.

It will be appreciated from the equation 1 above that the voltage generated across R1 is a PTAT voltage. As such the circuit of FIG. 3 provides a self biased PTAT voltage generator. This PTAT voltage generating circuit can be used for a variety of purposes including for example a temperature reference or as a component cell within a bandgap reference circuit. Although it is common to use a resistor as a load across which a voltage may be generated it will be appreciated by those skilled in the art that equivalent load devices such as transistor configurations may also be used.

Figure 4:
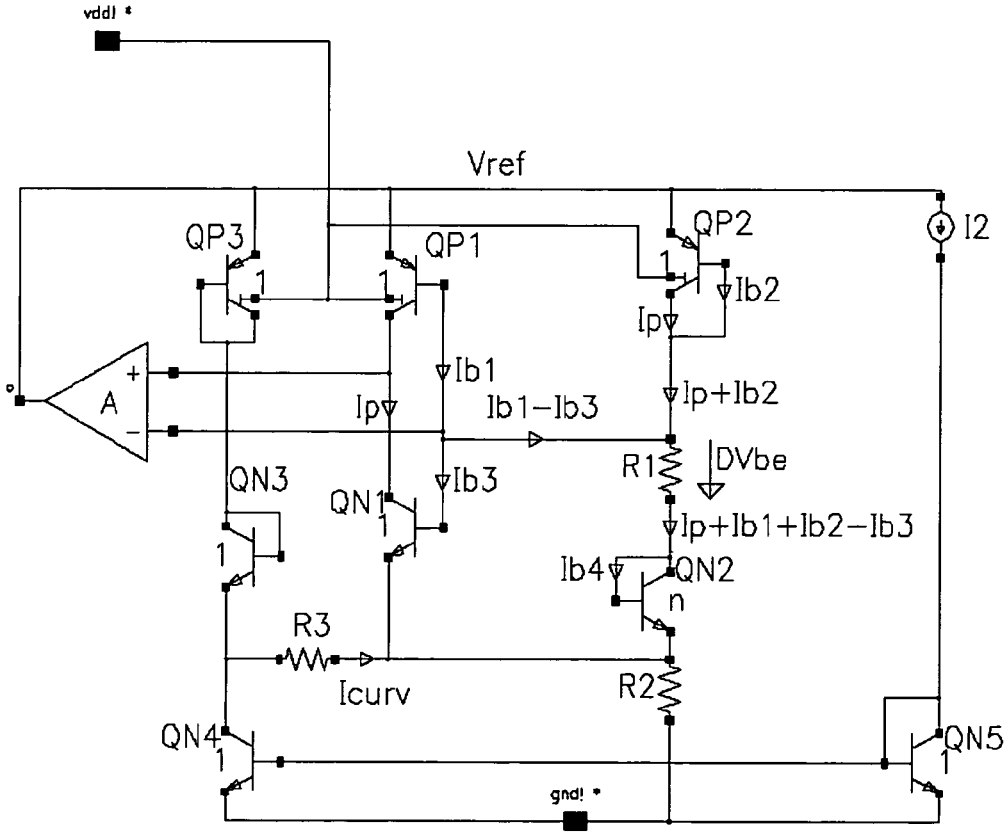
FIG. 4 is an example of a reference circuit including the PTAT circuit of FIG. 3 in accordance with the present invention.

FIG. 4 presents a first embodiment of a bandgap reference voltage circuit in accordance with the present invention. The circuit includes an amplifier A having an inverting and a non-inverting input and providing at its output a voltage reference, Vref. Coupled to the inputs of the amplifier are two PNP bipolar transistors, QP1, QP2, each having the same emitter area, two NPN bipolar transistors, QN1 and QN2, QN2 having an emitter area of n times that of QN1, and two resistors, R1 and R2. In a first arm of the circuit, the first PNP transistor QP1 is provided in a feedback configuration between the output node of the amplifier and the inverting input. The base of QP1 is coupled to the base of the first NPN transistor QN1 and is also coupled to the inverting input. The collector of transistor QN1 is coupled to the collector of transistor QP1, and also to the non-inverting input of the amplifier. In a second arm of the circuit, transistor QP2 is provided in a diode configuration with the base being directly coupled to the collector and also to the commonly coupled bases of QP1 and QN1, thereby connecting the first and second arms of the circuit. The emitter is coupled to the output node of the amplifier. Transistor QN2 is also provided in a diode configuration and the collector is coupled across resistor R1 to the base of QP2. The emitter of QN2 is coupled across resistor R2 to ground, and is directly coupled to the emitter of QN1. It will be appreciated that the components of FIG. 4, QN1, QN2, R1 and the amplifier, are all components of the PTAT cell of FIG. 3. The current mirror block of FIG. 3 is provided by the two PNP transistors QP1 and QP2: QP2 being the master transistor and QP1 the slave.

As was discussed above QN1 and QN2 each operate at a different collector current density and a PTAT voltage of the form of Eq. (1) is developed across R1. In the circuit of FIG. 4, this results in a corresponding PTAT current flowing from the reference voltage node "Vref" via QP2, R1, QN2, R2 to the ground, gnd. If QP1 is provided having the same emitter area as QP2, the current flowing from Vref to ground via QP1, QN1 and R2 is the same as the current flows from Vref node via QP2, R1, QN2, R2. The amplifier A, biased with a current I1, operating in accordance with known amplifier characteristics is adapted to keep the base-collector voltage of both transistors, QP1 and QN1, close to zero and also to generate the reference voltage at node Vref. As a result all four transistors in the main cell, QP1, QP2, QN1, QN2, are operating at zero base-collector voltage thereby reducing the Early effect to zero. With reference to FIG. 4, the reference voltage, Vref, consists of a PTAT voltage developed across r2 and two CTAT voltages which correspond to the base-emitter voltages of QP1 and QN1. This voltage is:

$$V_{ref} = \left(\Delta V_{be} * \frac{r_2}{r_1} + V_{be(QN1)} + V_{be(QP2)}\right) \tag{8}$$

If QP1 and QP2 have the same emitter area and because they have the same base-emitter voltage (both being coupled to Vref, their collector currents are the same. The collector current of QP1 also flows into the collector current of QN1. As a result QP1, QP2 and QN1 have all the same collector current, Ip. The collector current of QN2 is different due to the bias current of QP2 and the bias current difference of QP1 and QN1. These bias currents are related to what is commonly termed as a "beta" factor or β (ratio of the collector current to the bias current). Assuming beta factors being β1 for QP1, β2 for QP2, β3 for QN1 and β4 for QN2, then the collector current of QN2 ($I_c$(QN2))is:

$$I_c(QN_2) = I_p \frac{1 + \frac{1}{\beta_1} + \frac{1}{\beta_2} - \frac{1}{\beta_3}}{1 + \frac{1}{\beta_4}} = I_p * Err \tag{9}$$

The base-emitter voltage difference ($\Delta V_{be}$) developed across r1 will be:

$$\Delta V_{be} = \frac{KT}{q} \ln\left(n \frac{Ic(QN_1)}{Ic(QN_2)}\right) = \frac{KT}{q} \ln(n) + \frac{KT}{q} \ln[Err] \tag{10}$$

The second term of (10) is an error factor which can be minimised by properly scaling the emitter areas of the four bipolar transistors, QP1, QP2, QN1 and QN2. However, even if the four transistors are specifically chosen to minimise the effect of this beta factor error, there is a certain minimum intrinsic error that will remain resulting from beta factor variation due to the temperature and process variation. For a typical bipolar process we can assume that beta factors are greater than 100 and their relative variation is of the order of +/−15%. If this is the case the worst beta variation of the bipolar transistors will be reflected as an voltage variation of less than 1 mV into a 2.5V reference.

If the reference voltage is not curvature compensated, a typical curvature voltage is present on the reference voltage, as was described previously with reference to FIG. 2. The present invention provides, in certain embodiments, for a compensation of this inherent voltage curvature. In order to do this it is necessary to provide a T log T signal of opposite sign to the inherent T log T signal generated. The present invention provides for the generation of this T log T signal by providing a CTAT current I2, which may be externally generated from the circuit described thus far and using this current in combination with a third resistor, R3. The CTAT current I2 is mirrored via a diode configured transistor QN5 to another NPN transistor QN4 and the CTAT current reflected on the collector of QN4 is pulled from the reference node, Vref, via two bipolar transistors: QP3 of the same emitter area as QP1, and QN3 of the same emitter area as QN1. The resistor R3 is provided between the commonly coupled collector of QN4/emitter of QN3 and the emitter of QN1. As a result across R3 a voltage curvature of the form of T log T is developed. By properly scaling the ratio of R3 to R2 the voltage curvature is reduced to zero.

A very important feature of the circuit described thus far is related to the very low influence of any amplifier errors on the reference voltage. This is because the base-collector voltages of QP1 and QN1 have very little effect on their respective base-emitter voltages and collector currents and as a result the reference voltage provided at the output of the amplifier is not greatly affected by the amplifier's errors. It will be understood that the pairing of QP1 and QN1 provide an pre-amplification of the signal prior to the amplification effect of the amplifier A. They act, in effect as the first stage of an amplifier, thereby reducing the error contribution of the actual amplifier. In other words, the amplifier controls a parameter which has a second order effect on the reference voltage but at the same time it forces the necessary reference voltage.

The amplifier A can be formed as a simple amplifier having low gain by using for example MOS input components. The use of such components reduces the current taken by the amplifier to zero. As the total loop gain will be very high, the line regulation (or power supply rejection ratio (PSRR)) and load regulation will be very high as simulations shows.

Figure 5:
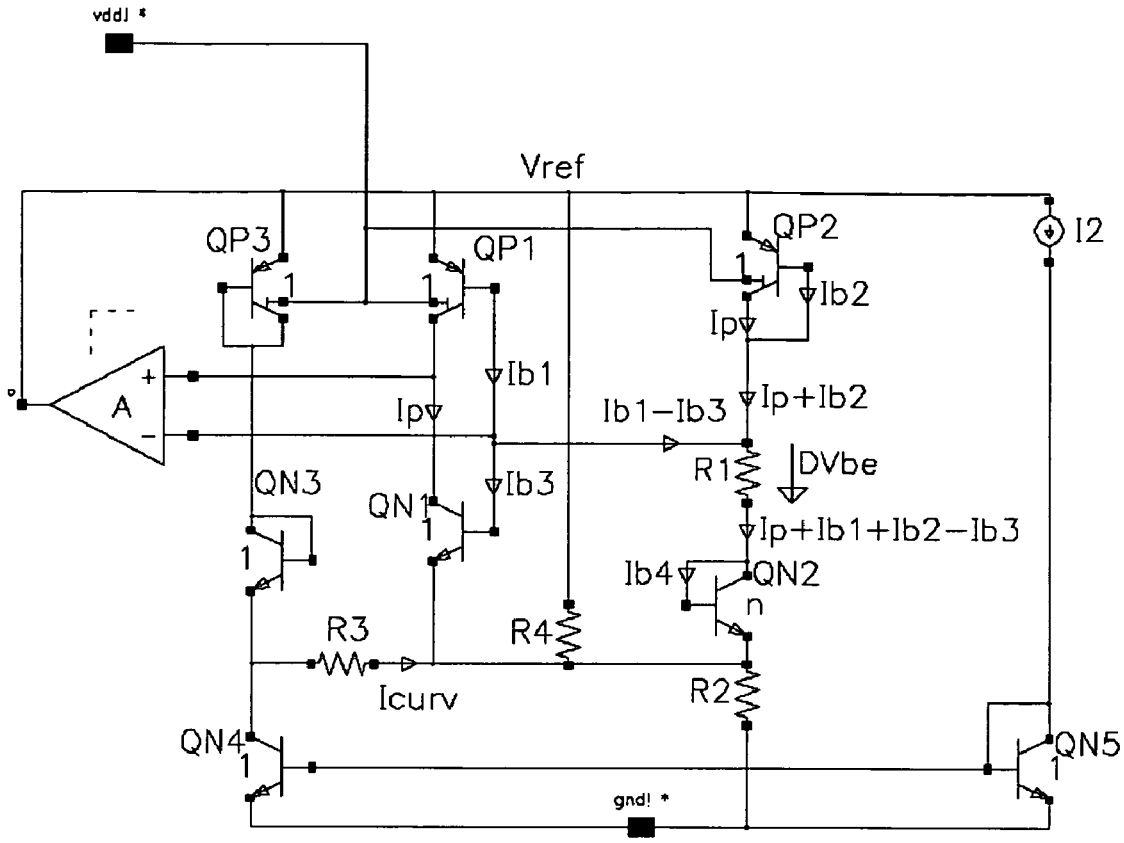
FIG. 5 is an example of a modification of the circuit of FIG. 4 so as to provide for a shifting of the output reference voltage to a desired level.

The circuit of FIG. 4 provides a bandgap voltage cell which will typically provide, using standard components, a reference voltage of the order of 2.3V. This voltage can be simply scaled to a standard voltage of 2.5V by modifying the circuit to insert a single resistor, R4, as shown in FIG. 5. One side of the resistor is coupled to the output of the amplifier and the other side is coupled to the common node between the emitter of QN1 and the emitter of QN2. Across this resistor, R4, a pure CTAT voltage is reflected generating a corresponding shifting CTAT current which flows into R2. By scaling R2 appropriately, the reference voltage may be provided with a flat response over the temperature range. As the supply current for the amplifier can be set very low and because there is no need for any resistor divider to set the reference voltage the resulting reference voltage will have very low supply current.

Figure 6:
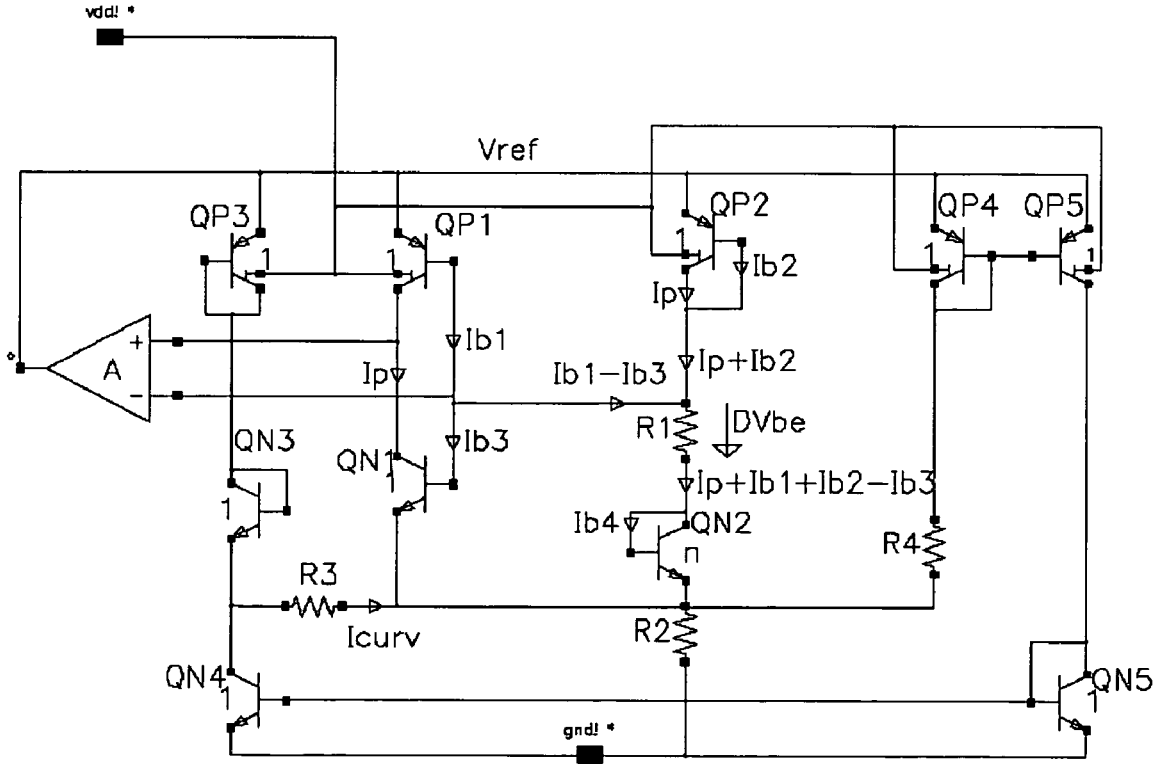
FIG. 6 is a further modification to the circuit of FIG. 4 so as to internally generate a CTAT current for the purpose of correcting the curvature at the output of the amplifier.

FIG. 6 shows a further modification to the circuit of FIG. 4 where a bipolar transistor, QP4, is provided in series between resistor R4 and the output of the amplifier. The provision of this transistor can generate and mirror a CTAT current, via another bipolar transistor QP5, so as to generate a bias voltage internally within the circuit thereby obviating the need for the externally generated current I2 present in FIGS. 4 and 5.

Figure 7:
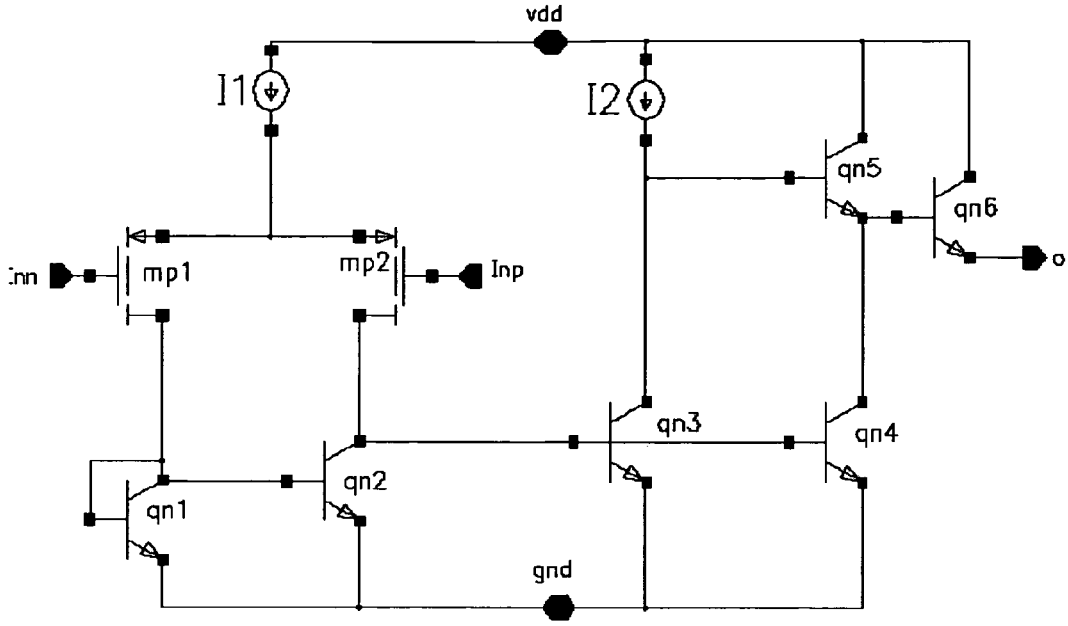
FIG. 7 is a schematic showing an implementation of the amplifier of the circuits of FIG. 4 to FIG. 6.

The amplifier in FIGS. 4 to 6 may be provided as a two stage MOS/bipolar amplifier and such components are explicitly detailed in FIG. 7. As shown in FIG. 7, the amplifier has two inputs, a non-inverting, Inp, and an inverting input, Inn. An output, o, is also provided. The input stage of the amplifier is based on two pMOS devices, mp1 and mp2 biased with a current I1. The loads into the first stage are qn1 and qn2. The second stage is an inverter, qn3, biased with a current I2. Transistor devices qn5 and qn6 form a Darlington pair in order to provide the required output current.

Figure 8:
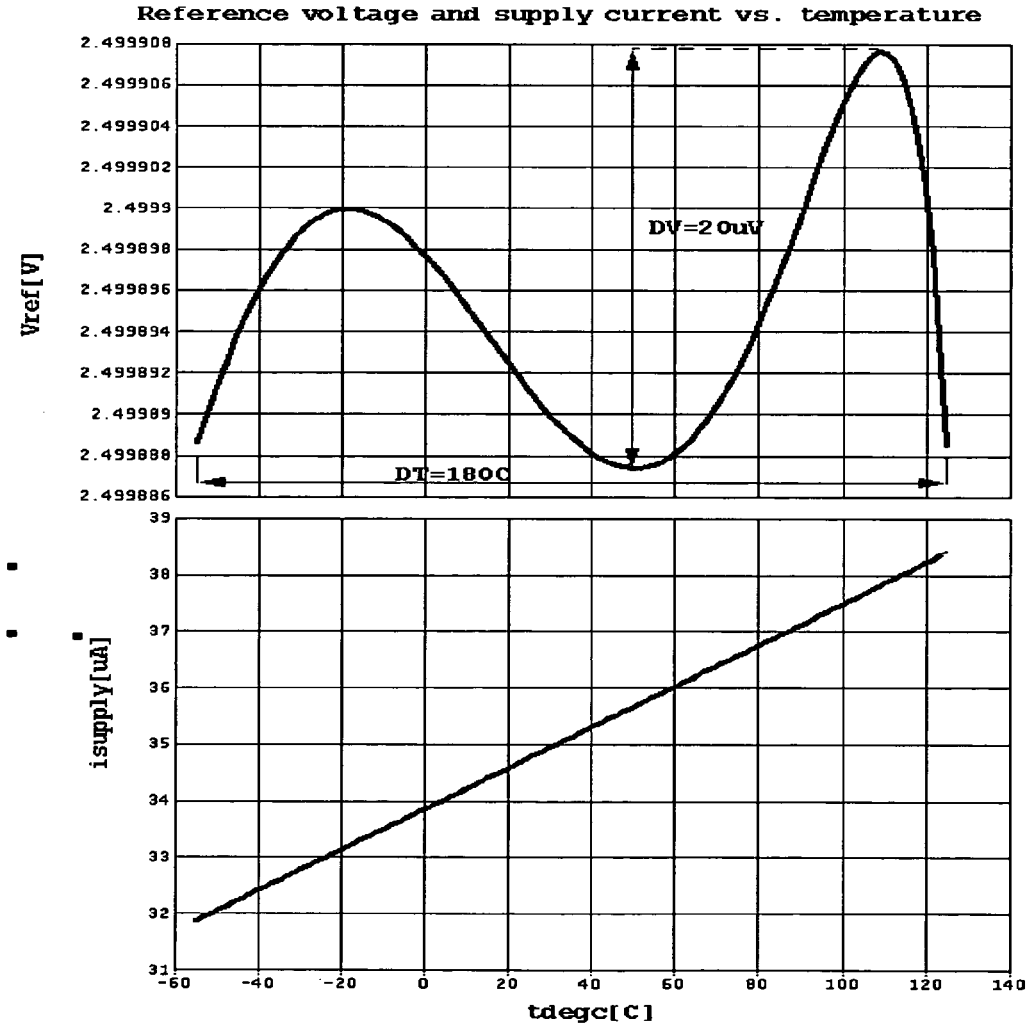
FIG. 8 is an example of a simulated performance characteristics of a circuit in accordance with the present invention showing the reference voltage for the extended temperature range, from −55 C to 125 C and total supply current.

A simulation of the performance of the circuits of FIGS. 4 to 7 was conducted for an extended temperature range, from −55 C to 125 C and total supply current, and is shown in FIG. 8. As this picture shows the total voltage variation is about 20 uV which corresponds to 0.05 ppm. As it is seen the total supply current is less than 41 uA. In a typical Brokaw cell (FIG. 1) when generating a reference voltage at the amplifier's output of the order of 2.5V the voltage drop across r5 is about 1.25V. As a result the only current flowing into the resistor divider, r5 r6, is of the order of 100 uA, more than twice total supply current for the circuit according to FIGS. 4 to 7.

FIG. 9 presents the deviation from the straight line (or curvature) of the base-emitter voltage of qp3 plus qn3, (FIG. 6) and the corresponding voltage deviation of qp1 plus qn2. Their difference, ΔV, presented on the bottom of the FIG. 9. This curvature difference of the order of 5 mV at room temperature is reflected across r3. A corresponding current will flow from r3 to r2 for exact cancellation of the curvature voltage of the base-emitter voltage of qp1 plus qn1.

Simulations of the reference voltage assuming firstly no offset and secondly where a 5 mV offset voltage is present at the input of the amplifier indicate that a 5 mV offset voltage of the amplifier is reflected as 0.12 mv into the reference voltage. This corresponds to a reduction of the offset input voltage by a factor of more than 40 as compared to a reduction of the order of 2 as may be achieved in a typical Brokaw cell.

Figure 10:
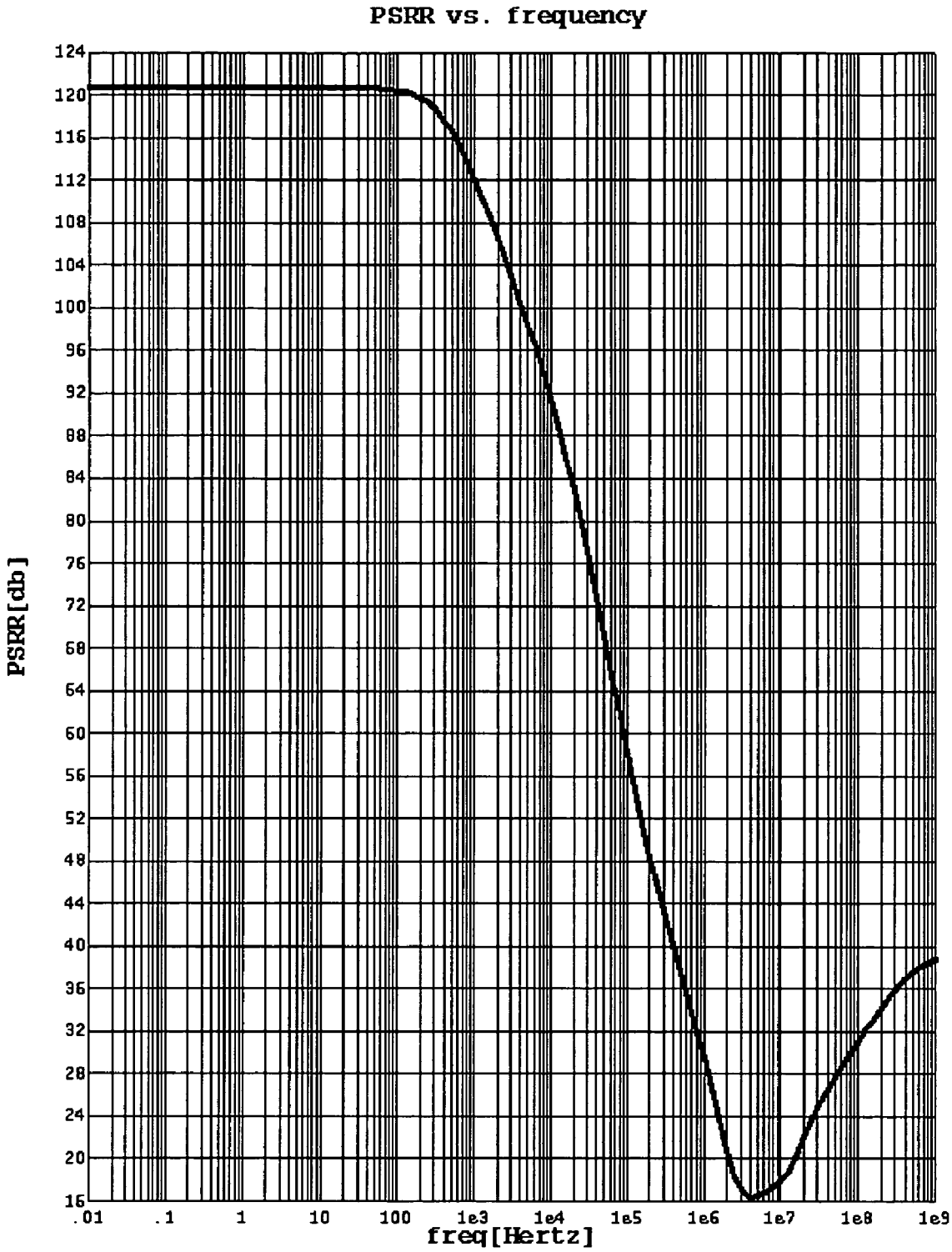
FIG. 10 is an example of a simulated performance characteristics of a circuit in accordance with the present invention showing the reference voltage supply rejection, or PSRR.

FIG. 10 presents the reference voltage supply rejection, or PSRR. This very high PSRR is due to high open loop gain primarily due to QP1 and QN1.

It was also possible to simulate the line regulation or reference voltage variation vs. supply voltage. In one example a variation of 7.5V into the supply voltage is reflected as a 7 uV change into the reference voltage which correspond to a relative variation of less than 0.0001%.

Figure 11:
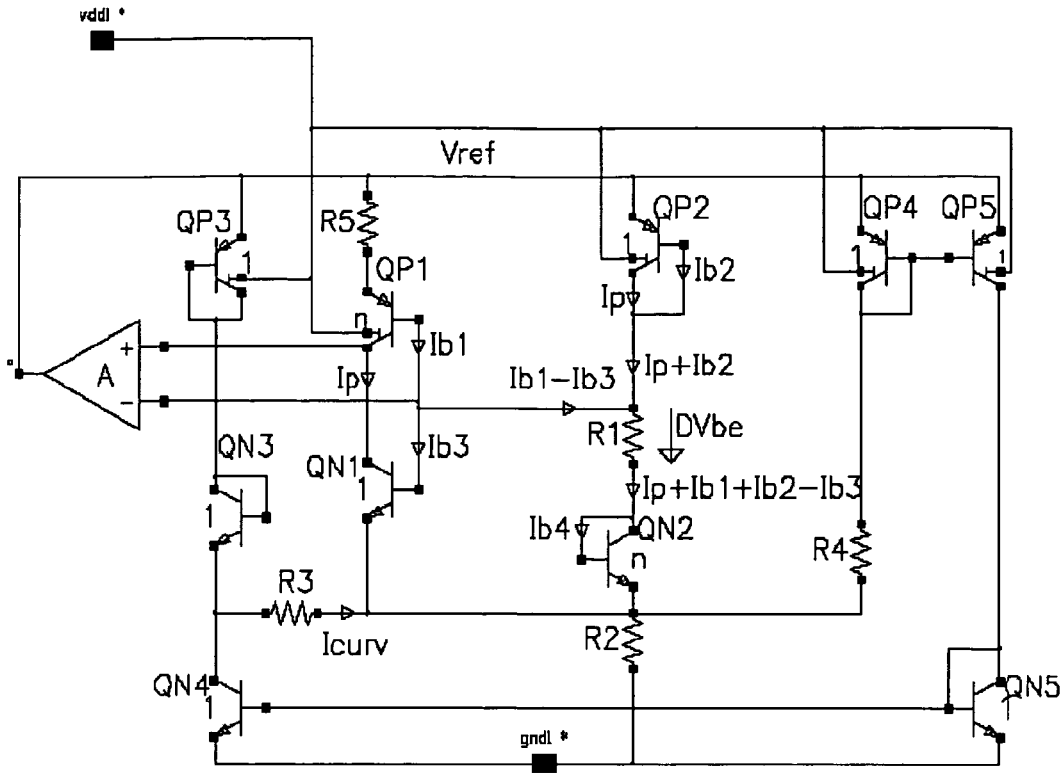
FIG. 11 shows a modification to the circuit of FIG. 6 so as to increase the open loop gain of the circuit.

As FIG. 10 has shown, the circuits of the present invention can provide a high open loop gain. This open loop gain can be increased more and the noise can also be reduced if QP1 and QP2 are each set to have a different current density, for example by making QP1 as a multiple emitter device and inserting a resistor from the reference voltage node to the emitter of QP1 as FIG. 11 shows. The circuit of FIG. 11 is substantially the same as the circuit of FIG. 6 except that the emitter ratio of QP1 to QP2 is "n", the same as the corresponding ratio for QN2 and QN1 and a new resistor, R5 is inserted between the reference voltage and the emitter of QP1.

The circuit according to FIG. 11 was also simulated using typical value for the component devices and it was found that the PSRR achievable using this modified circuit is about 10 db greater as compared to FIG. 10. It was also found that the total noise of the circuit according to FIG. 11 is half that compared to FIG. 10 and this is mainly because QP1 has larger emitter area and it also has a degeneration resistor.

Figure 12:
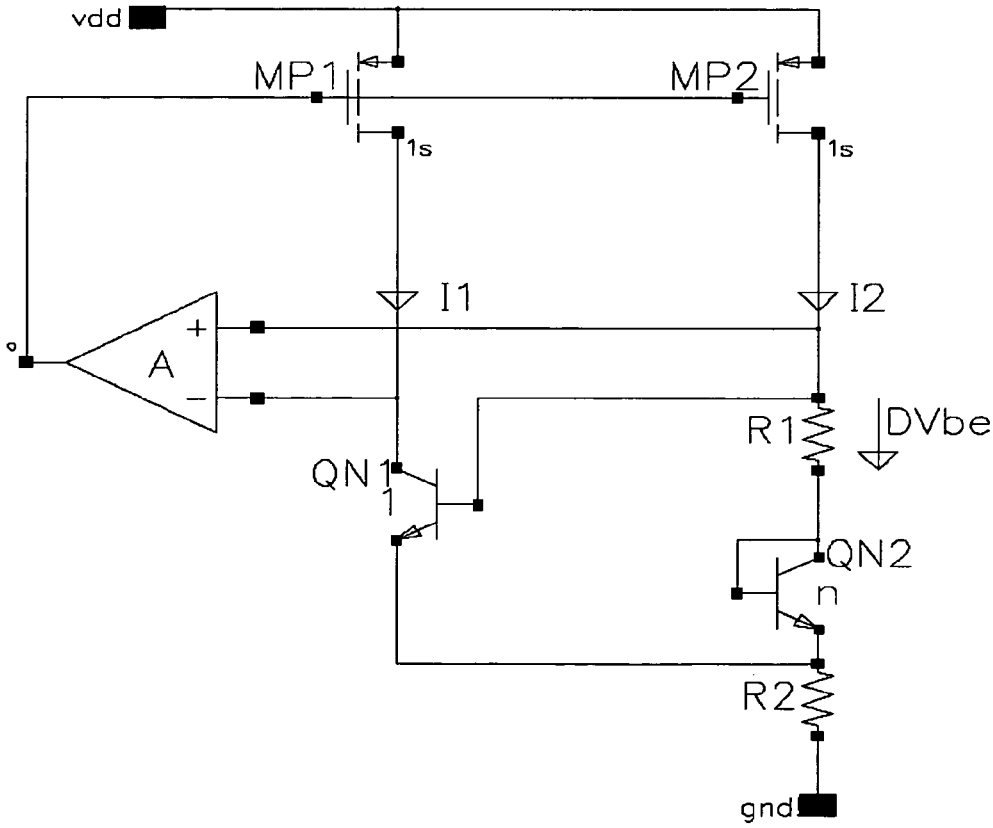
FIG. 12 is an example of an implementation of a circuit in accordance with the present invention using bipolar/CMOS technology.

As will be apparent to the person skilled in the art, the two PNP transistors (QP1, QP2) that are provided on each of the arms of the circuit of FIGS. 4–6 and 11 effectively form the current mirror circuit 300 of FIG. 3 which is used to drive the NPN transistors that are coupled to the inputs of the amplifier. Such a current mirror 300, which can be easily provided in either a bipolar (as shown in FIGS. 4–6 and 11) or MOS configuration, as shown in FIG. 12. As shown in FIG. 12, the currents I1 and I2 which are provided to the transistors NP1 and NP2, may be provided by MOS devices MP1 and MP2 (in this example shown as P type devices) whose gates are coupled to the output of the amplifier and whose sources are coupled to Vdd. In this way, the circuit provides a bridge arrangement of transistors coupled to first and second inputs of the amplifier, with a first arm of the bridge including a transistor operating at a first current density and a second arm of the bridge operating at a second, higher, current density. A measure of the difference in base emitter voltages between the two transistors is provided by a resistor network coupled to the second arm. The first arm is coupled to an intermediate point on the resistor network and both arms are coupled via the current mirror to the output of the amplifier. Such coupling of each of the arms via the mirror to the output serves to drive the bases of each of the transistors with the same voltage and as their collectors are also at the same potential (each collector being coupled to a respective input of the amplifier) the circuit serves to reduce the base collector voltages of the transistors to a minimum value, thereby reducing the Early effect.

Similarly, it will be understood that the present invention provides a bandgap voltage reference circuit that utilises an amplifier with an inverting and non-inverting input and providing at its output a voltage reference. First and second arms of circuitry are provided, each arm being coupled to a defined input of the amplifier. By providing an NPN and PNP bipolar transistor in a first arm and coupling the bases of these two transistors together it is possible to connect the two arms of the amplifier. This provides a plurality of advantages including the possibility of these transistors providing amplification functionality equivalent to a first stage of an amplifier. By providing a "second" amplifier it is possible to reduce the complexity of the architecture of the actual amplifier and also to reduce the errors introduced at the inputs of the amplifier.

It will be understood that the present invention has been described with specific PNP and NPN configurations of bipolar transistors but that these descriptions are of exemplary embodiments of the invention and it is not intended that the application of the invention be limited to any such illustrated configuration. It will be understood that many modifications and variations in configurations may be considered or achieved in alternative implementations without departing from the spirit and scope of the present invention. Specific components, features and values have been used to describe the circuits in detail, but it is not intended that the invention be limited in any way except as may be deemed necessary in the light of the appended claims. It will be further understood that some of the components of the circuits hereinbefore described have been with reference to their conventional signals and the internal architecture and functional description of for example an amplifier has been omitted. Such functionality will be well known to the person skilled in the art and where additional detail is required may be found in any one of a number of standard text books.

Similarly the words comprises/comprising when used in the specification are used to specify the presence of stated features, integers, steps or components but do not preclude the presence or addition of one or more additional features, integers, steps, components or groups thereof.

The invention claimed is:

1. A voltage circuit including a first amplifier having first and second inputs and having an output driving a current mirror circuit, outputs from the current mirror circuit driving first and second n-type bipolar transistors which are coupled to the first and second input of the amplifier respectively, the base of the first n-type transistor being coupled to the second input of the amplifier and the collector of the first transistor being coupled to the first input of the amplifier such that the amplifier keeps the base and collector of the first transistor at the same potential, the second n-type transistor being provided in a diode configuration, and wherein the first and second n-type transistors are adapted to operate at different current densities such that a difference in base emitter voltages between the first and second n-type transistors may be generated across a resistive load coupled to the second n-type transistor, the difference in base emitter voltages being a PTAT voltage, the circuit additionally including first and second p-type bipolar transistors, the first p-type transistor being provided in a feedback configuration between the output node of the amplifier and the inverting input of the amplifier, the second p-type transistor being provided in a diode configuration with the base and collector being commonly coupled via the resistor to the second n-type transistor, the base of the first p-type transistor being coupled to the base of the first n-type transistor and also to the inverting input of the amplifier, the collector of the first p-type transistor being coupled to the collector of the first n-type transistor and also to the non-inverting input of the amplifier, the arrangement of the first p-type and first n-type transistors providing a pre-amplification of the signal prior to the amplification provided by the amplifier.

2. The circuit as claimed in claim 1 wherein the current mirror circuit includes a master and a slave transistor, the master transistor being coupled to the second n-type transistor and the slave transistor being coupled to the first n-type transistor, the master transistor being the second p-type transistor and the slave being the second p-type transistor.

3. The circuit as claimed in claim 2 wherein the slave and first transistor form a first stage of an amplifier.

4. The circuit as claimed in claim 1 wherein the resistive load is provided in series between the base of the first n-type transistor and the collector of the second n-type transistor.

5. The circuit as claimed in claim 1 wherein the base of the first n-Wpe transistor is directly coupled to the collector of the second n-type transistor, the resistive load being provided in series between the emitter of the second n-type transistor and the emitter of the first n-type transistor.

6. The circuit as claimed in claim 1 wherein the the emitters of the first and second n-type transistors are both coupled via a second resistive load to ground.

7. The circuit as claimed in claim 1 wherein the base emitter voltages of the first n-type transistor and the slave transistor provide a complementary to absolute temperature (CTAT) voltage which is combined by the amplifier with the PTAT voltage to provide a voltage reference at the output of the amplifier.

8. The circuit as claimed in claim 7 wherein the emitters of the first and second n-type transistors are both coupled via a second resistive load to ground, the circuit including additional circuitry adapted to provide curvature correction, the additional circuitry including a CTAT current source and a third resistive load, the third resistive load being coupled to the emitters of the first and second n-type transistors and whereby a scaling of the value of the second and third resistive loads may be used to correct for curvature.

9. The circuit as claimed in claim 7 wherein the CTAT current is mirrored by a second set of current mirror circuitry, the second set of current mirror circuitry including a master and a slave transistor and wherein the slave transistor is coupled to the output of the amplifier through two diode connected transistors, the third resistive load being coupled to the slave transistor, such that a CTAT current reflected on the collector of the slave transistor is pulled from the output of the amplifier so as to generate across the third resistive load a signal of the type of T log T.

10. The circuit as claimed in claim 9 wherein the CTAT current source is externally provided to the circuit.

11. The circuit as claimed in claim 9 further including a fourth resistive load, the fourth resistive load being provided between the output of the amplifier and the commonly coupled emitters of the first and second n-type transistors, the provision of the fourth resistive load enabling a scaling of the voltage provided at the output of the amplifier.

12. The circuit as claimed in claim 2 wherein the emitter areas of the master and slave transistors are different, such that the master and slave transistors operate at different current densities thereby increasing the open loop gain of the circuit.

13. A voltage circuit including a first amplifier having first and second inputs and having a first and second transistor coupled to the first and second inputs respectively, the first transistor being additionally coupled to the second input of the amplifier such that the amplifier keeps the base and collector nodes of the first transistor at the same potential, the second transistor being operable at a higher current density to that of the first transistor such that a difference in base emitter voltages between the two transistors may be generated across a load, and wherein the circuit is further configured to include a current mirror circuit provided in a feedback path between the amplifier output and the first and second transistor, the current mirror being adapted to supply a base current for the first and second transistors such that the base collector voltage of each of the transistors is minimized thereby reducing the Early effect, the current mirror circuit including a master and a slave transistor, the master transistor being coupled to the second transistor and the slave transistor being coupled to the first transistor, the slave and first transistor being arranged to form a first stage of an amplifier.

14. The circuit as claimed in claim 13 wherein the master and slave transistors are provided as p-type transistors and the first and second transistors are provided as n-type transistors.

15. The circuit as claimed in claim 13 wherein the master and slave transistors are provided as n-type transistors and the first and second transistors are provided as p-type transistors.

16. The circuit as claimed in claim 13 wherein the load is provided in series between the base of the first transistor and the collector of the second transistor.

17. The circuit as claimed in claim 13 wherein the base of the first transistor is directly coupled to the collector of the second transistor, the load being provided in series between the emitter of the second transistor and the emitter of the first transistor.

18. The circuit as claimed in claim 13 wherein the emitters of the first and second transistors are both coupled via a second load to ground.

19. The circuit as claimed in claim 14 wherein the base emitter voltages of the first transistor and the slave transistor provide a complementary to absolute temperature (CTAT) voltage which is combined by the amplifier with a PTAT voltage provided by the difference in base emitter voltages between the two transistors generated across the load to provide a voltage reference at the output of the amplifier.

20. The circuit as claimed in claim 19 wherein the emitters of the first and second transistors are both coupled via a second load to ground, the circuit including additional circuitry adapted to provide curvature correction, the additional circuitry including a CTAT current source and a third load, the third load being coupled to the emitters of the first and second transistors and whereby a scaling of the value of the second and third loads may be used to correct for curvature.

21. The circuit as claimed in claim 20 wherein the CTAT current is mirrored by a second set of current mirror circuitry, the second set of current mirror circuitry including a master and a slave transistor and wherein the slave transistor is coupled to the output of the amplifier through two diode connected transistors, the third load being coupled to the slave transistor, such that a CTAT current reflected on the collector of the slave transistor is pulled from the output of the amplifier so as to generate across the third load a signal of the type of T log T.

22. The circuit as claimed in claim 20 wherein the CTAT current source is externally provided to the circuit.

23. The circuit as claimed in claim 20 further including a fourth load, the fourth load being provided between the output of the amplifier and the commonly coupled emitters of the first and second transistors, the provision of the fourth load enabling a scaling of the voltage provided at the output of the amplifier.

24. The circuit as claimed in claim 14 wherein the emitter areas of the master and slave transistors are different, such that the master and slave transistors operate at different current densities thereby increasing the open loop gain of the circuit.

25. A bandgap voltage reference circuit comprising a bridge arrangement of transistors including a first and second arm providing first and second inputs to an amplifier which in turn provides a voltage reference as an output, wherein each arm of the bridge includes a transistor, the transistor of the second arm being operable at a higher current density to that of the transistor of the first arm such that a voltage reflective of the difference in base emitter voltages between the first and second transistors is generated across a resistor within a resistor network provided as part of the second arm, and further wherein the first arm is coupled at an intermediate point within the network to the second arm and the bridge is coupled to the voltage reference from the amplifier output such that the amplifier reduces the base collector voltage of the transistor of the first arm, the circuit further including a current mirror circuit, the current mirror circuit including a master and a slave transistor, the master transistor being coupled to the transistor of the second arm and the slave transistor being coupled to the transistor of the first arm, the slave and transistor of the first arm form a first stage of an amplifier.

26. The circuit as claimed in claim 25 wherein the slave and transistor of the first arm form a first stage of an amplifier.

27. The circuit as claimed in claim 26 wherein the master and slave transistors are provided as p-type transistors and the first and second transistors are provided as n-type transistors.

28. The circuit as claimed in claim 26 wherein the master and slave transistors are provided as n-type transistors and the first and second transistors are provided as p-type transistors.

29. The circuit as claimed in claim 25 wherein the resistor is provided in series between the base of the transistor of the first arm and the collector of the transistor of the second arm.

30. The circuit as claimed in claim 29 wherein the base of the transistor of the first arm is directly coupled to the collector of the transistor of the second arm, the resistor being provided in series between the emitter of the transistor of the second arm and the emitter of the transistor of the first arm.

31. The circuit as claimed in claim 29 wherein the emitters of the transistors of the first and second arms are both coupled via a second resistor of the network to ground.

32. The circuit as claimed in claim 25 wherein the base emitter voltages of the transistor of the first arm and the slave transistor provide a complementary to absolute temperature (CTAT) voltage which is combined by the amplifier with a PTAT voltage provided by the difference in base emitter voltages between the transistors of the two arms generated across the resistor to provide a voltage reference at the output of the amplifier.

33. The circuit as claimed in claim 32 wherein the emitters of the transistors of the first and second arms are both coupled via a second resistor of the network to ground, the circuit including additional circuitry adapted to provide curvature correction, the additional circuitry including a CTAT current source and a third resistor, the third resistor being coupled to the emitters of the transistors of the first and second arms and whereby a scaling of the value of the second and third resistors may be used to correct for curvature.

34. The circuit as claimed in claim 33 wherein the CTAT current is mirrored by a set of current mirror circuitry, the current mirror circuitry including a master and a slave transistor and wherein the slave transistor is coupled to the output of the amplifier through two diode connected transistors, the third resistor being coupled to the slave transistor, such that a CTAT current reflected on the collector of the slave transistor is pulled from the output of the amplifier so as to generate across the third resistor a signal of the type of T log T.

35. The circuit as claimed in claim 33 wherein the CTAT current source is externally provided to the circuit.

36. The circuit as claimed in claim 34 further including a fourth resistor, the fourth resistor being provided between the output of the amplifier and the commonly coupled emitters of the transistors of the first and second arms, the provision of the fourth resistor enabling a scaling of the voltage provided at the output of the amplifier.

37. A bandgap voltage reference circuit including a first amplifier having first and second inputs and providing at its output a voltage reference, the circuit including:

a first arm coupled to the first input, the first arm having a first and second transistor of the circuit, the bases of each of the first and second transistor being coupled together, the first transistor being additionally coupled to the amplifier output, a second arm coupled to the second input, the second arm having a third and fourth transistor of the circuit and a load resistor, the fourth transistor having an emitter area larger than that of the second transistor, the third transistor being coupled to the amplifier output, and wherein:

the load resistor provides, in use, a measure of the difference in base emitter voltages of the second and fourth transistors, $\Delta Vbe$, for use in the formation of the bandgap reference voltage, the commonly coupled bases of the first and second transistors are additionally coupled to the base of the third transistor and the second input of the amplifier thereby coupling the first and second arms and providing a base current for all three transistors, the amplifier, in use, keeping the base and collector of the first transistor at the same potential.

38. A method of providing a bandgap reference circuit, the method comprising:

providing a first amplifier having first and second inputs and generating, in use, at its output a voltage reference, providing a first arm coupled to the first input, the first arm having a first and second transistor of the circuit, the bases of each of the first and second transistors being coupled together, the first transistor being additionally coupled to the amplifier output, providing a second arm coupled to the second input, the second arm having a third and fourth transistor of the circuit and a load resistor, the fourth transistor having an emitter area larger than that of the second transistor, the third transistor being coupled to the amplifier output, such that, in use, the load resistor provides a measure of the difference in base-emitter voltages of the second and fourth transistors, $\Delta Vbe$, for use in the formation of the bandgap reference voltage, and wherein the commonly coupled bases of the first and second transistors are additionally coupled to the base of the third transistor and the second input of the amplifier thereby coupling the first and second arms and providing a base current for all three transistors, the amplifier, in use, keeping the base and collector of the first transistor at the same potential.

* * * * *

UNITED STATES PATENT AND TRADEMARK OFFICE

CERTIFICATE OF CORRECTION

PATENT NO. : 7,173,407 B2
APPLICATION NO. : 10/881300
DATED : February 6, 2007
INVENTOR(S) : Stefan Marinca It is certified that error appears in the above-identified patent and that said Letters Patent is hereby corrected as shown below:

Claim 5 should read:

5. The circuit as claimed in claim 1 wherein the base of the first n-type transistor is directly coupled to the collector of the second n-type transistor, the resistive load being provided in series between the emitter of the second n-type transistor and the emitter of the first n-type transistor.

Signed and Sealed this

Seventeenth Day of June, 2008

JON W. DUDAS
*Director of the United States Patent and Trademark Office*

UNITED STATES PATENT AND TRADEMARK OFFICE

CERTIFICATE OF CORRECTION

PATENT NO. : 7,173,407 B2
APPLICATION NO. : 10/881300
DATED : February 6, 2007
INVENTOR(S) : Stefan Marinca It is certified that error appears in the above-identified patent and that said Letters Patent is hereby corrected as shown below:

Column 13, lines 9-13,

Claim 5 should read:

5. The circuit as claimed in claim 1 wherein the base of the first n-type transistor is directly coupled to the collector of the second n-type transistor, the resistive load being provided in series between the emitter of the second n-type transistor and the emitter of the first n-type transistor.

This certificate supersedes the Certificate of Correction issued June 17, 2008.

Signed and Sealed this

Twenty-second Day of July, 2008

JON W. DUDAS
*Director of the United States Patent and Trademark Office*